US007654422B2

(12) United States Patent
Fujiwara

(10) Patent No.: US 7,654,422 B2
(45) Date of Patent: Feb. 2, 2010

(54) NEEDLE THREADER

(75) Inventor: Yasuhiro Fujiwara, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 142 days.

(21) Appl. No.: 12/009,265

(22) Filed: Jan. 17, 2008

(65) Prior Publication Data

US 2008/0169320 A1 Jul. 17, 2008

(30) Foreign Application Priority Data

Jan. 17, 2007 (JP) ..... 2007-008388

(51) Int. Cl.
*D05B 87/02* (2006.01)
*D05B 87/00* (2006.01)

(52) U.S. Cl. ..... 223/99

(58) Field of Classification Search ..... 223/99; 112/224, 225

See application file for complete search history.

(56) References Cited

U.S. PATENT DOCUMENTS 2,567,408 A * 9/1951 Soderberg ..... 223/99
3,006,518 A * 10/1961 Lillard ..... 223/99
3,404,707 A * 10/1968 Feld ..... 139/1 R
3,893,602 A * 7/1975 Ivy ..... 223/99
4,008,836 A * 2/1977 Herzstein ..... 223/99
4,422,564 A * 12/1983 Koenig et al. ..... 223/99
5,165,582 A * 11/1992 Andrews ..... 223/99
5,311,889 A * 5/1994 Ringle et al. ..... 132/321
5,988,463 A * 11/1999 DiCarlo et al. ..... 223/99

FOREIGN PATENT DOCUMENTS

JP 8-4948 2/1996

* cited by examiner

*Primary Examiner*—Ismael Izaguirre
(74) *Attorney, Agent, or Firm*—Hamre, Schumann, Mueller & Larson, P.C.

(57) ABSTRACT

A needle threader includes a flat handle portion and a thread-introducing loop portion extending from the handle portion. The thread-introducing loop portion includes a folded insertion edge at a tip for insertion into an eye of a needle. The thread-introducing loop portion includes a plate member having a first end, a second end, and a narrow band portion integrally connecting between the first and second ends. The narrow band portion has the folded insertion edge at a lengthwise center. The first end and the second end of the plate member are laid one on another and held in the handle portion. The narrow band portion is exposed from the handle portion to form the thread-introducing loop portion.

6 Claims, 2 Drawing Sheets

NEEDLE THREADER

BACKGROUND OF THE INVENTION

1. Field of the Invention

The present invention relates to a needle threader for use in threading a sewing needle or the like.

2. Description of the Related Art

In the field of handicraft such as embroidery and sewing, a needle threader is known which is a tool for facilitating threading of an embroidery needle or the like. Typically, a needle threader includes a thread-introducing loop portion that can be passed through the eye of a needle, and a handle portion attached to the thread-introducing loop portion. The handle portion is formed of a thin metal plate for example, and is adapted to be pinched with the fingers. The thread-introducing loop portion has a thin wire of a circular cross-section formed into an approximately diamond-shaped loop, for example, so that the loop can be inserted into the needle eye by utilizing a pointed tip.

There is also known a needle threader which has a thread-introducing loop portion formed of a flat metal wire (see Japanese Utility Model Publication No. 8-004948 for example). In the needle threader disclosed in this publication, the flat-shaped (or plate-shaped) metal wire is folded into an approximately diamond-shaped loop so that the metal wire has a flat cross section having a long axis orthogonal to a plane constituting the diamond-shaped loop. According to such a structure, when the thread-introducing loop portion is passed through the needle eye, the tip end of the thread-introducing loop portion is inserted into the needle eye in the state where the long axis of the cross section of the metal wire extends in the longitudinal direction of the needle eye. The thread-introducing loop portion is pulled back through the needle eye after a thread is passed through the thread-introducing loop portion. At this time, the thread is placed in the folded loop portion located at the end of the thread-introducing loop portion, along the long axis of the cross section of the metal wire. Thus, as shown in FIGS. 4 and 6 in the above-described publication, the portions of the thread passed through the needle eye are placed at a distance from each other in the longitudinal direction of the needle eye. As such, according to the needle threader disclosed in the above publication, even if the thread is relatively thick, it is possible to pull out the thread-introducing portion, while the thread is being held thereby, without causing the thread and the thread-introducing loop portion to get stuck at the needle eye.

Meanwhile, the thread-introducing loop portion has its end portion attached to the handle portion made of a thin metal plate. As shown in FIG. 1 in the above publication, the metal wire has a cross section whose long axis is orthogonal to a flat axis of the handle portion. Thus, in order to attach the end portion of the thread-introducing loop portion to the handle portion, the handle portion is applied with a cut, for example, and the end portion of the thread-introducing loop portion is inserted into the cut and, then, the cut portion is pressed for so-called caulking. With this configuration, however, when the thread-introducing loop portion repeatedly receives a pulling force toward its end, it may be torn off at its portion attached to the handle portion. Furthermore, an impact applied to the attaching portion may cause undesirable deformation of the end of the thread-introducing loop portion and/or the handle portion.

SUMMARY OF THE INVENTION

It is therefore an object of the present invention to provide a needle threader which ensures that a thread-introducing loop portion passed through a needle eye for threading can be pulled out smoothly without causing the thread and the thread-introducing loop portion to get stuck at the needle eye, and which appropriately maintains an attached state of the thread-introducing loop portion to a handle portion.

A needle threader according to the present invention comprises a flat handle portion and a thread-introducing loop portion extending from the handle portion. The thread-introducing loop portion includes a folded insertion edge at a tip for insertion into an eye of a needle. The thread-introducing loop portion comprises a plate member having a first end, a second end, and a narrow band portion integrally connecting between the first and second ends. The narrow band portion has said folded insertion edge at a lengthwise center. The first end and the second end of the plate member are laid one on another and held in the handle portion. The narrow band portion is exposed from the handle portion to form said thread-introducing loop portion.

Preferably, the folded insertion edge of the thread-introducing loop portion is elongated in a direction in which the needle eye is elongated.

In a preferred embodiment, the first end has a greater size than the second end, and the first end has an ornamental pattern formed by etching a portion not laid on the second end. Further, the handle portion is formed of a transparent resin.

Preferably, each of the first end and the second end has an engagement hole, and the engagement hole of the first end is aligned with the engagement hole of the second end. Further, the handle portion has an engagement projection inserted through the engagement holes of the first and second ends.

Preferably, the narrow band portion has an intermediate portion between the insertion edge and the first end and another intermediate portion between the insertion edge and the second end, and the intermediate portions is curved moderately such that a distance between the intermediate portions increases as a position in the intermediate portions approaches a lengthwise center of the intermediate portions.

The other features and advantages of the present invention will become apparent from the following detailed description of the present invention when taken in conjunction with the accompanying drawings.

DESCRIPTION OF THE PREFERRED EMBODIMENTS

A preferred embodiment of the present invention will now be described in detail with reference to the accompanying drawings.

Figure 1:
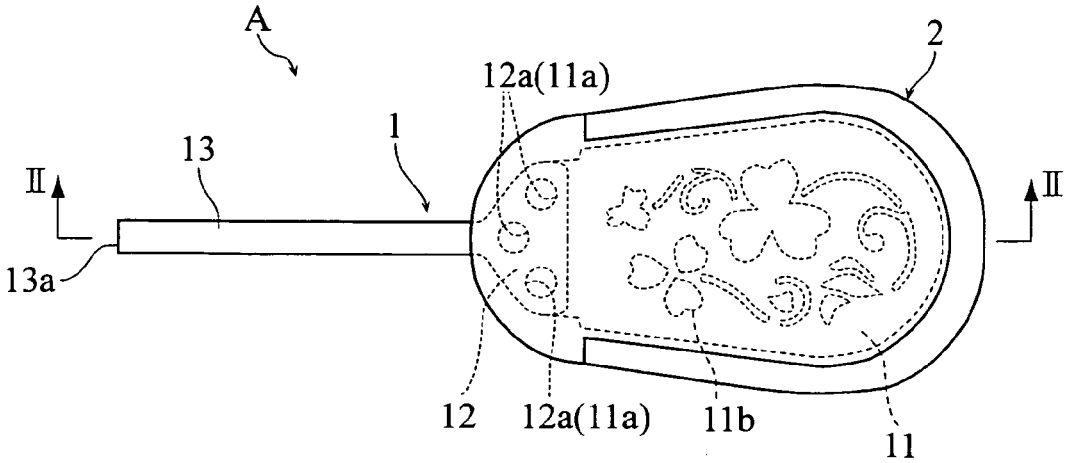
FIG. 1 is a plan view showing an example of a needle threader according to the present invention.
Figure 2:
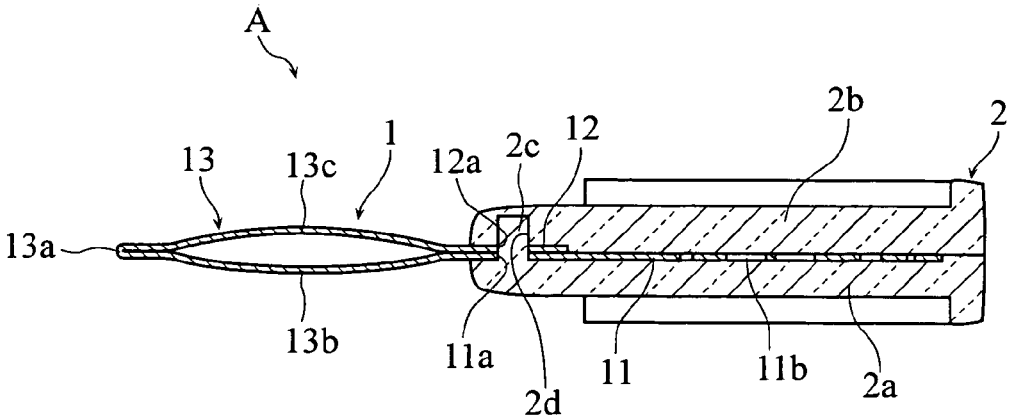
FIG. 2 is a cross sectional view taken along the line II-II in FIG. 1.

As shown in FIGS. 1 and 2, a needle threader A according to an embodiment of the present embodiment includes a plate member 1 and a handle portion 2.

The plate member 1 includes a first end 11, a second end 12, and a narrow band portion 13 connecting these ends. The plate member 1 is formed in one piece by subjecting a thin metal plate such as a stainless steel spring member to stamping or etching for example. The plate member 1 has a thickness of, e.g., about 0.1 mm.

The narrow band plate portion 13 extends in a straight line with a constant width. The narrow band plate portion 13 is folded at a lengthwise intermediate position to provide a folded insertion edge 13*a*. A portion 13*b* of the plate 13 located between the folded insertion edge 13*a* and the first end 11 as well as another portion 13*c* of the plate 13 located between the folded portion 13*a* and the other end 12 is curved moderately in a manner that these curved portions come farther apart from each other as they each approach its lengthwise center. The insertion edge 13*a* and the curved portions 13B and 13C may be formed by subjecting the narrow band portion 13 to presswork, for example.

The first and second ends 11, 12 are wider than the narrow band portion 13, and they are laid one on another while being held within the handle portion 2. Each of the ends 11, 12 is provided with a plurality of (e.g., three) engagement holes 11*a*, 12*a*, respectively, penetrating in the thickness direction. Each engagement hole 11*a* of the first end 11 is aligned with a corresponding engagement hole 12*a* of the second end 12 when the ends 11, 12 are laid one on the other. The first end 11 has a greater size than the second end 12. The first end 11 has an ornamental pattern 11*b* provided as perforations in a region not overlapping the second end 12. The ornamental pattern 11*b* may be formed by subjecting the first end 11 to etching for material removal.

The handle portion 2 is formed of a transparent synthetic resin, which may be AS resin for example. The handle portion 2 has a flat shape as a whole to be conveniently nipped between the thumb and the pointing finger. The handle portion 2 also serves to hold the overlapping ends 11, 12 of the plate member 1 therein. More specifically, the handle portion 2 includes first and second members 2*a*, 2*b* which are welded together into one piece with the ends 11, 12 sandwiched between these two members. Such welding of the two members 2*a*, 2*b* may be performed by ultrasonic bonding or high frequency welding. The first member 2*a* of the handle portion 2 has integral engagement projections 2*c* which are inserted through the engagement holes 11*a*, 12*a* of the plate member 1 into complementary recesses 2*c*. In the needle threader A, while the ends 11, 12 of the plate member 1 are housed and secured in the handle portion 2, the narrow band portion 13 is exposed from the handle portion 2 to form a thread-introducing loop portion that can be passed through the eye of a needle.

Figure 3:
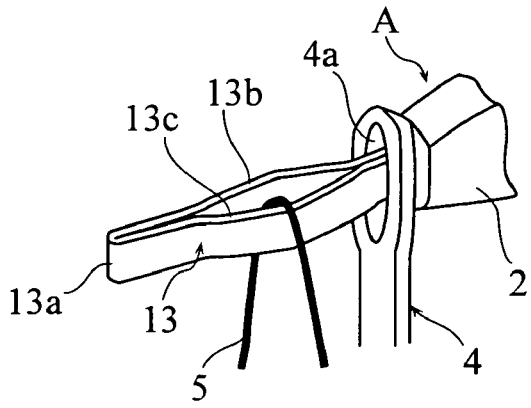
FIGS. 3 and 4 are perspective views showing how to use the needle threader according to the present invention.
Figure 4:
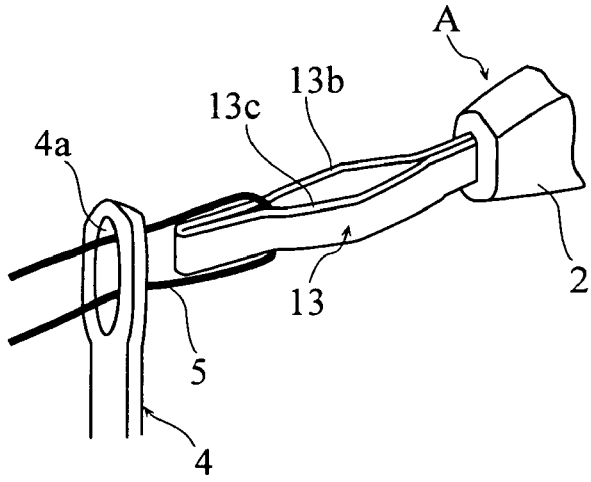

In use of the needle threader A of the present embodiment, as shown in FIG. 3, the insertion edge 13*a* of the narrow band portion 13 is passed through the eye 4*a* of a needle 4 in such a manner that the width direction of the narrow band portion 13 coincides with the longitudinal direction of the needle eye 4*a*, and a thread 5 is passed through the narrow band portion 13 that has been inserted into the needle eye 4*a*. Then, as shown in FIG. 4, the narrow band portion 13 is pulled out of the needle eye 4*a* with the thread 5 being left passed therethrough. In this manner, threading of the thread 5 through the needle eye 4*a* is finished.

As described above, in the needle threader A of the present embodiment, when inserting the narrow band portion 13 into the needle eye 4*a*, the width direction of the narrow band plate portion 13 is aligned with the longitudinal direction of the needle eye 4*a*. Accordingly, when pulling the narrow band plate portion 13 out of the needle eye 4*a*, the thread 5 that has been passed through the narrow band portion 13 extends in the width direction of the narrow band plate portion 13, and thus, the plane including the thread 5 is oriented in the longitudinal direction of the needle eye 4*a*. This ensures that the portions of the thread 5 being passed through the needle eye 4*a* are apart from each other in the longitudinal direction of the needle eye 4*a*, so that the thread 5 and the narrow band portion 13 can be pulled out smoothly without getting stuck at the needle eye 4*a* (see FIG. 4). Furthermore, the narrow band portion 13 is formed into a loop shape with the moderately curved portions 13*b*, 13*c* thereof. Such a structure is advantageous in that it is possible to reduce the resistance due to elastic deformation of the narrow band portion 13 when pulling it out of the needle eye 4*a*.

In the needle threader A of the present embodiment, the plate member 1 formed in one piece is secured in the handle portion 2 in the state where its ends 11, 12 are laid one on the other. Accordingly, even if a pulling force is repeatedly applied to the ends 11, 12 during a threading operation, the ends 11, 12 would not come off the handle portion 2. Furthermore, the ends 11, 12 covered with the handle portion 2 well withstand the impact. As such, it is possible to maintain the state where the narrow band portion 13 (the thread-introducing loop portion) is appropriately secured to the handle portion 2, which prolongs the service life of the needle threader. In the needle threader A, the engagement projection 2*c* of the handle portion 2 is inserted through the engagement holes 11*a*, 12*a* formed at the respective ends 11, 12 of the plate member 1, which ensures appropriate positioning of the ends 11, 12 with respect to the handle portion 2.

Furthermore, the handle portion 2 is formed of a transparent resin, and its interior can be seen therethrough. This allows the ornamental pattern 11*b* formed at the first end 11 of the plate member 1 housed and secured in the handle portion 2 to be viewed from the outside, consequently providing an attractive appearance.

While the specific embodiment of the present invention has been explained above, the present invention is not limited thereto, and various modifications are possible within the range not departing from the concept of the invention. For instance, the specific shapes and materials of the respective portions of the needle threader of the present invention are not limited to those of the above embodiment.

Furthermore, the needle threader of the present invention may be configured such that the narrow band portion exposed from the handle portion is covered with a resin cap when not in use, to prevent undesirable contact of the narrow band portion with a foreign article.

What is claimed is:

1. A needle threader comprising a flat handle portion and a thread-introducing loop portion extending from the handle portion, the thread-introducing loop portion including a folded insertion edge at a tip for insertion into an eye of a needle;

wherein the thread-introducing loop portion comprises a plate member having a first end, a second end, and a narrow band portion integrally connecting between the first and second ends, the narrow band portion having said folded insertion edge at a lengthwise center;

wherein the first end and the second end of the plate member are laid one on another and held in the handle portion, the narrow band portion being exposed from the handle portion to form said thread-introducing loop portion;

wherein the first end has a greater size than the second end, the first end has an ornamental pattern formed at a portion not laid on the second end; and wherein the handle portion is formed of a transparent resin.

2. The needle threader according to claim 1, wherein the gripping portion has a flat axis that extends in an in-plane direction of the first end or the second end.

3. The needle threader according to claim 1, wherein the ornamental pattern includes perforations formed in the first end.

4. The needle threader according to claim 1, wherein each of the first end and the second end has an engagement hole, the engagement hole of the first end being aligned with the engagement hole of the second end, and the handle portion has an engagement projection inserted through the engagement holes of the first and second ends.

5. The needle threader according to claim 1, wherein the narrow band portion has an intermediate portion between the insertion edge and the first end and another intermediate portion between the insertion edge and the second end, the intermediate portions being curved moderately such that a distance between the intermediate portions increases as a position in the intermediate portions approaches a lengthwise center of the intermediate portions.

6. A needle threader comprising a flat handle portion and a thread-introducing loop portion extending from the handle portion, the thread-introducing loop portion including a folded insertion edge at a tip for insertion into an eye of a needle;

wherein the thread-introducing loop portion comprises a plate member having a first end, a second end, and a narrow band portion integrally connecting between the first and second ends, the narrow band portion having said folded insertion edge at a lengthwise center;

wherein the first end and the second end of the plate member are laid one on another and held in the handle portion, the narrow band portion being exposed from the handle portion to form said thread-introducing loop portion;

wherein at least one of the first end and the second end is enlarged to have a greater width than the band portion for providing an ornamental pattern within the handle portion; and wherein the handle portion is formed of a transparent resin.

* * * * *